United States Patent [19]

Vogler

[11] 4,339,124

[45] Jul. 13, 1982

[54] NECK EXERCISING DEVICE

[76] Inventor: Daniel Vogler, 505 W. Gear St., Raymondville, Tex. 78580

[21] Appl. No.: 193,589

[22] Filed: Oct. 3, 1980

[51] Int. Cl.[3] ..... A63B 23/00

[52] U.S. Cl. ..... 272/94; 272/117

[58] Field of Search ..... 272/94, 117, 119, 122, 272/143

[56] References Cited

U.S. PATENT DOCUMENTS

| | | | |
|---|---|---|---|
| 500,686 | 7/1893 | Corker | 272/94 |
| 1,047,212 | 12/1912 | Hamilton | 272/119 |
| 3,128,095 | 4/1964 | Sharkey | 272/94 |
| 3,820,780 | 6/1974 | Tarbox | 272/94 |
| 4,109,908 | 8/1978 | Pugh | 272/119 |
| 4,129,193 | 8/1980 | Newman | 272/94 |
| 4,168,060 | 9/1979 | Hohenfeldt | 272/94 |

FOREIGN PATENT DOCUMENTS

| | | | |
|---|---|---|---|
| 487905 | 11/1952 | Canada | 272/94 |

*Primary Examiner*—Richard J. Johnson
*Attorney, Agent, or Firm*—Fred Philpitt

[57] ABSTRACT

My invention pertains to a neck exercising device that includes a football helmet, bar bell discs and means for supporting said discs on said helmet.

1 Claim, 4 Drawing Figures

NECK EXERCISING DEVICE

A number of exercise devices are known for improving the strength of neck muscles. The following U.S. Patents are representative of such devices—No. 500,686; No. 1,047,212; No. 3,128,095; No. 3,820,780; and No. 4,168,060.

A drawback of all these prior devices is that their construction is specialized to the extent that one must purchase the entire device from the manufacturer, which means that the cost is substantial.

An object of my invention is to provide a neck exercise device that includes some components that many athletes already have, thus greatly reducing the cost of the complete unit. More particularly my exercise device includes as components a football helmet and bar bell discs (or weight discs) which are items owned by most athletes, gyms and athletic departments.

My invention will be more clearly understood by referring to the drawing wherein.

Figure 1:
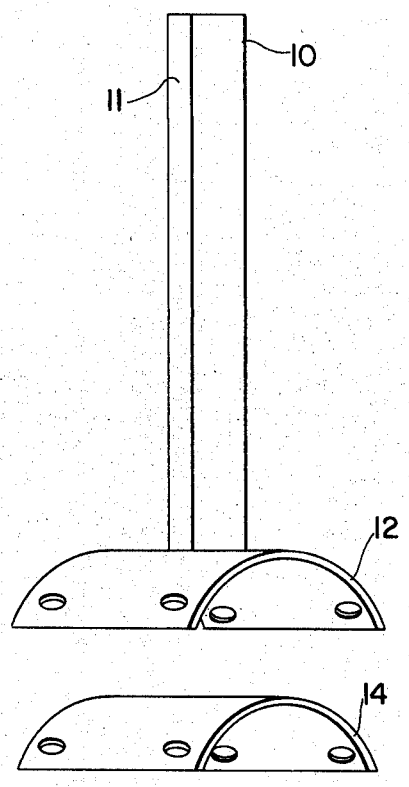
FIG. 1 shows three components of my invention, two of which are joined together.

FIG. 1 illustrates three of the components of my exercising device that are not presently available in athletic departments, gyms or sporting good stores. These three components include an elongated steel bar 10, a curved steel plate 12 and a rubber bushing 14. Bar 10 is preferably cylindrical.

The elongated steel bar 10 is preferably about 7 inches in length and about 1 inch in diameter. It is designed to stand in an essentially vertical direction. The curved steel plate 12 is preferably about ⅛ inch thick, 2.5 inches in width and 6–7 inches in length. The bottom end of the elongated steel bar 10 is welded or otherwise secured to the convex surface of said curved steel plate 12. The rubber bushing 14 has approximately the same size and shape as said curved steel plate 12. Both the curved steel plate and the rubber bushing have a plurality of holes therein as shown.

Figure 2:
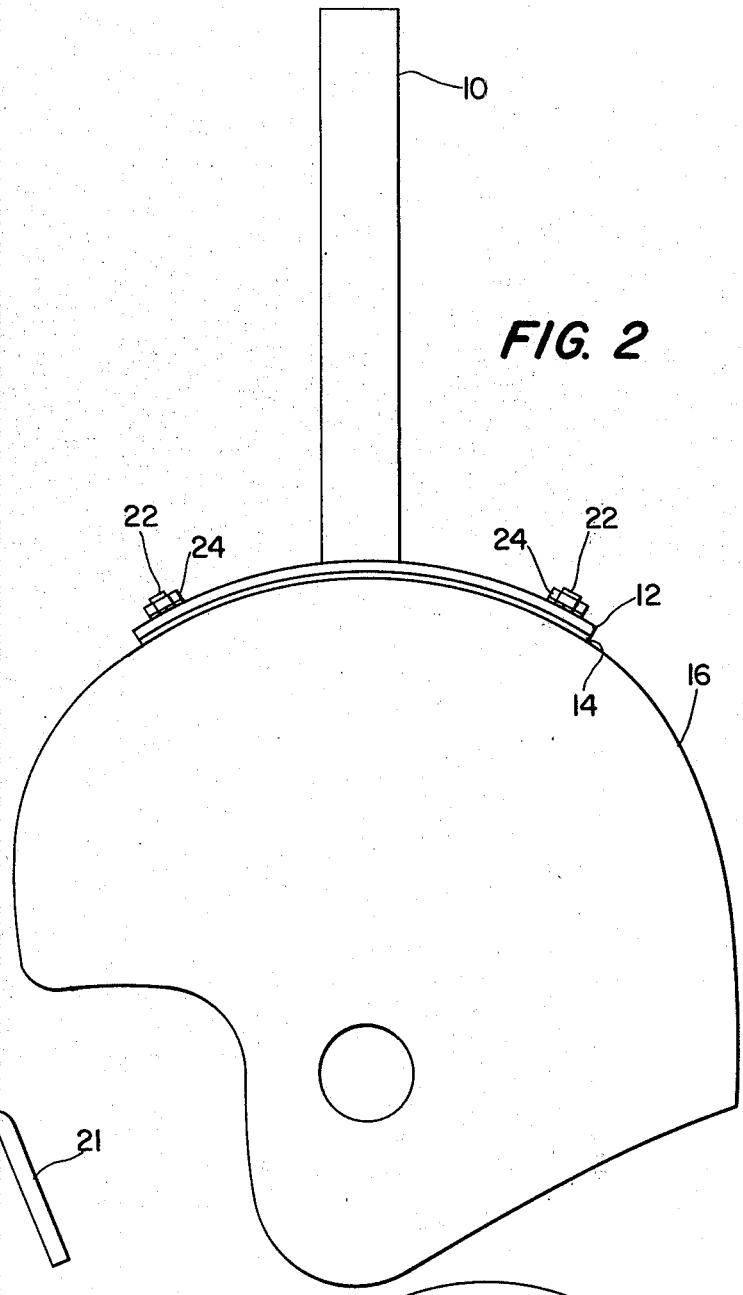
FIG. 2 shows the components of FIG. 1 mounted on a football helmet.
Figure 3:
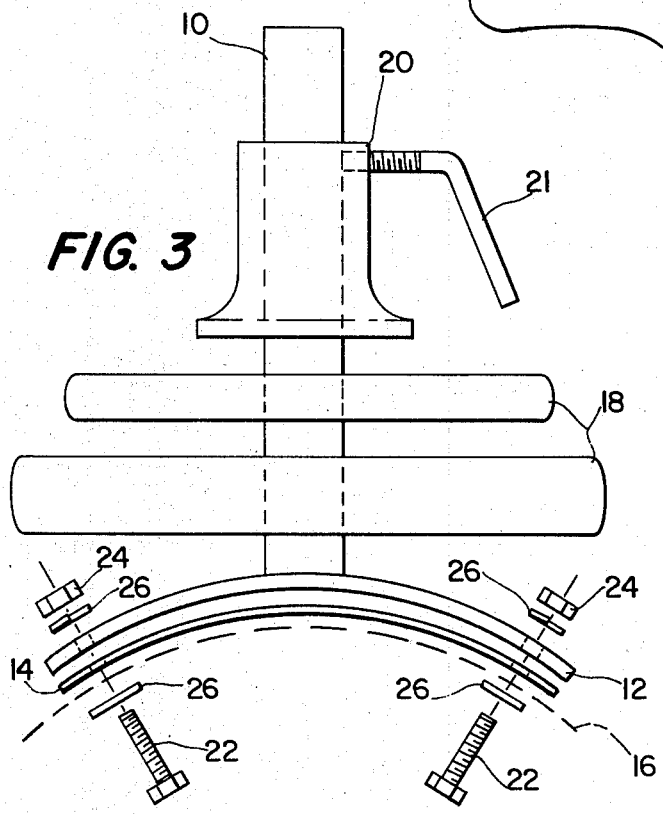
FIG. 3 shows how bar bell discs are mounted and secured to the components of FIGS. 1 and 2.

The aforesaid three "new" components of my exercise device are combined with three "old" components that can be found in most gyms, athletic departments and sporting goods stores. These three "old" components are a football helmet 16, bar bell discs 18 and a locking collar 20. The old and new components are combined as indicated in FIGS. 2 and 3. More specifically, as is illustrated in FIG. 2, bolts 22, nuts 24 and washers 26 are used to secure the curved steel plate 12 and the rubber bushing 14 firmly to the helmet 16. The concave surface of the curved steel plate 12 has a curvature which closely approximates the curvature of the convex top portion of the football helmet 16. The curved steel plate 12 has a degree of flexibility which favors conformance of the curvatures. If the bushing 14 is omitted the chances of the bolts and nuts loosening will increase.

Figure 4:
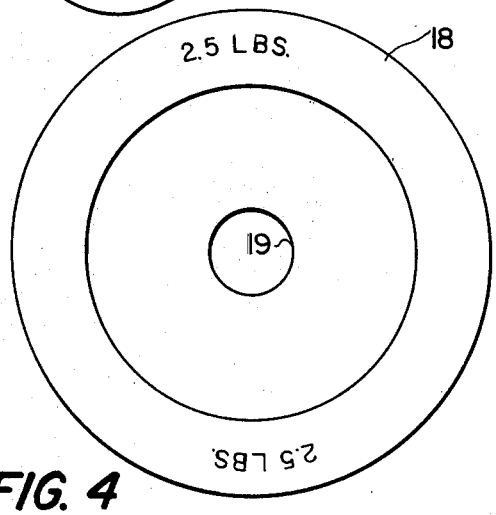
FIG. 4 shows a plan view of a bar bell disc.

Once the aforesaid components have been assembled as shown in FIG. 2, one or more bar bell discs can be slipped over the bar 10. FIG. 4 shows the usual bar bell disc having a central opening 19. FIG. 3 shows two such bar bell discs slipped over the bar 10, the lower disc weighing 5 lbs and the upper disc weighing 2.5 lbs. The bar bell discs are secured in place on the bar 10 by a locking collar 20 that also fits down over the bar 10. Locking collars are used on nearly all bar bell disc weight lifting devices and usually involve turning a threaded member 21 until it presses against the bar on which the discs are supported, thus preventing movement of the collar.

The bar 10 can be either perfectly round in cross section or one portion can have a flat surface (shown as 11 in FIG. 1) in order to better insure that the locking collar 20 will not disengage from bar 10 due to twisting movements by the user.

When my device is placed on an athlete's head and the chin strap fastened, the athlete is then ready to exercise his neck by rotating his head in a clockwise direction for 90 seconds. He then reverses and moves his head in a counter-clockwise direction for ninety seconds. Finally, while standing still, the athlete moves his head from side-to-side and back and forth for ninety seconds. As the athlete progresses he may add weights and increase the time.

My device saves money because it permits the use of discarded football helmets and standard weight plates.

I claim:

1. A neck exercising device comprising in combination (a) a football helmet that is adapted to be strapped securely on the head;

(b) an elongated steel bar located immediately above the central top portion of said football helmet with the longitudinal axis of said steel bar extending in an essentially vertical direction, (c) a curved steel plate which is about ⅛ inch thick, 2.5 inches in width and 6–7 inches in length, the curvature of said plate corresponding to the curvature of the top portion of said football helmet, the bottom end of said elongated steel bar being welded to the convex surface of said curved steel plate, (d) a rubber bushing having approximately the same size and shape as said curved steel plate, the entire undersurface of said rubber bushing being secured flush against the upper central surface of said football helmet and the entire undersurface of said curved steel plate being secured flush against the upper surface of said rubber bushing, said securement being effected by a plurality of fastening means that are located at spaced apart portions of said curved steel plate and which fastening means extend through both said curved steel plate, said rubber bushing and the upper central portion of said football helmet, (e) at least one bar bell disc with a central bore mounted on said vertically disposed steel bar, each said bar bell disc being disposed in a generally horizontal plane and bearing its weight downwardly on the top of said curved steel plate, and (f) a locking collar mounted on said steel bar at a point immediately above the upper most bar bell disc so as to secure said bar bell disc against upwardly movement.

* * * * *